US009381514B2

(12) United States Patent
Arias y Arias De Sáaveora

(10) Patent No.: US 9,381,514 B2
(45) Date of Patent: Jul. 5, 2016

(54) TEST TUBE

(71) Applicant: Nirco, S.L., Barbera Del Valles (ES)

(72) Inventor: Jesús Arias y Arias De Sáaveora, Barbera del Valles (ES)

(73) Assignee: Nirco, S.L., Barbera Del Valles (ES)

( * ) Notice: Subject to any disclaimer, the term of this patent is extended or adjusted under 35 U.S.C. 154(b) by 0 days.

(21) Appl. No.: 14/411,813

(22) PCT Filed: Jul. 2, 2013

(86) PCT No.: PCT/ES2013/000155

§ 371 (c)(1),
(2) Date: Apr. 1, 2015

(87) PCT Pub. No.: WO2014/006237

PCT Pub. Date: Jan. 9, 2014

(65) Prior Publication Data

US 2015/0224495 A1 Aug. 13, 2015

(30) Foreign Application Priority Data

Jul. 4, 2012 (ES) ..... 201200714

(51) Int. Cl.

| | |
|---|---|
| ***B01L 3/14*** | (2006.01) |
| ***B01L 3/00*** | (2006.01) |
| ***B41M 5/26*** | (2006.01) |

(52) U.S. Cl.

CPC ..... *B01L 3/5082* (2013.01); *B01L 3/5453* (2013.01); *B41M 5/267* (2013.01); *B01L 2300/021* (2013.01); *B01L 2300/0832* (2013.01); *B01L 2300/0858* (2013.01); *B01L 2300/12* (2013.01); *B01L 2300/168* (2013.01); *B41M 2205/04* (2013.01)

(58) Field of Classification Search

CPC ..... B01L 3/5453; B01L 3/00
See application file for complete search history.

(56) References Cited

U.S. PATENT DOCUMENTS

| | | | | |
|---|---|---|---|---|
| 5,928,780 | A | 7/1999 | Schmidt et al. | |
| 6,797,779 | B1 * | 9/2004 | Ajbani | C08F 279/02 524/424 |
| 2002/0106309 | A1 | 8/2002 | Mathus et al. | |
| 2011/0308335 | A1 * | 12/2011 | Pink | B01L 3/5453 73/864.91 |

FOREIGN PATENT DOCUMENTS

| | | | |
|---|---|---|---|
| JP | H10295805 | A | 11/1998 |
| WO | 9805427 | A1 | 2/1998 |

OTHER PUBLICATIONS

International Search Report issued in corresponding International Application No. PCT/ES2013/000155 mailed on Aug. 22, 2013.

* cited by examiner

*Primary Examiner* — Jyoti Nagpaul
(74) *Attorney, Agent, or Firm* — Davis & Bujold PLLC; Michael J. Bujold

(57) ABSTRACT

TEST TUBE, of the type that are used for chemical and biological analysis, having an approximate shape of a cylinder or a truncated cone, comprising an opening in the upper region thereof for inserting substances, and formed from a single piece of a homogeneous material with a translucent color, composed of a mixture of a polymer from the family of metallocene polyolefins, that homogeneously contains a polypropylene-based Masterbach of a laser-sensitive additive that changes color to a different contrasting color, for example an approximately brown-black color, when exposed to the excitation of a laser marker.

7 Claims, No Drawings

TEST TUBE

FIELD OF THE INVENTION

The present invention relates to a test tube of the type that is used for chemical and biological analysis, said test tube intended to enable permanent marking on the surface thereof.

PRIOR ART

Massive use of inexpensively manufactured plastic test tubes intended for performing chemical and biological tests requires the identification of the test tubes employed for proper handling and identification thereof. For instance, in modern laboratories said identification by means of a code on the test tubes becomes essential for enabling the automation of the process that includes transport, storage, relocation and collection of said test tubes.

The importance of the tests and the results obtained therefrom, for instance for the correct diagnosis of a patient, requires the records to be highly reliable and an insurance against errors in said identification codes of the test tubes or the samples.

That is the reason why adhesive notes, for instance, are not an option since during the various processes undergone by the tubes tags are apt to peel off the original tubes and, what is even more grievous, may end up adhered to adjacent tubes placed in test-tube racks.

There are other means in the prior art to mark tubes with reference codes that are not so fragile and easy to misplace away from the tubes such as adhesive notes and that do not permit easy transference between units. For instance, thermally-transferred sheets or tapes that engrave the surface of test tubes have been used. It has also been used ink-jet printing, tampography, etc.

However with all the above procedures there persists the problem that the bonding of the ink or the marking substance on the tube surface is not actually the bonding of two non-detachable components. It is not a permanent marking. Said marks can be removed with a suitable solvent, in the case of paints or inks, or even mechanically as a result of brushing or scratching without this compromising the integrity of the tube.

Consequently, it is the main object of the present invention to provide a test tube that incorporates a reference code that cannot be removed unless the test tube itself is destroyed.

U.S. Pat. No. 20022106309 describes a test tube of those used for analyses and clinical trials whose bottom portion is reinforced by two layers, one of them being opaque and the other being colored, that are made through stamping. This technique enables a laser to modify one of the layers which as a result takes on contrast with the other, this enabling reading of a code.

However, the above technique is costly as it requires the adaptation or modification of the bottoms of the tubes and it is not versatile in the sense that the industry has used lateral marking of tubes and has at its disposal automated readers for lateral reading of the test tubes that cannot be used with these marked tubes marked on the bases thereof because they require specific readers.

Besides, the side of the tube is the ideal spot for marking thereof because it is on the side of the tube where there is provided enough space for making the annotations which incidentally are very visible to the human eye and permit the use of reading devices.

Another of the main objects of the present invention is, therefore, performing a test tube having the permanent marking of a reference code that both enables lateral marking and is at the same time easy and economical to manufacture.

These and other advantages of the present invention will become clear during the course of the description thereof.

BRIEF EXPLANATION OF THE INVENTION

The present invention describes a test tube made of a composition suitable for enabling permanent marking of the side of the tube such that it is not possible the elimination or modification thereof unless by proceeding to the destruction or damage of the tube itself, which would in turn render it useless for further use.

To that end it is performed a tube with two materials that are conveniently mixed to form a homogeneous material that will subsequently be used for manufacturing the test tube. One of these two materials is an additive, which in the suitable concentration, enables laser marking of the tube.

The base material of the tube is translucent and the additive is selected so that, once excited by a pre-determined laser marker, it produces a brown-black color that permits inscription of a code.

In this manner all the objects sought by the invention are achieved. For instance, it has been obtained indelible and permanent marking that cannot be removed unless the test tube is rendered unusable. Besides, thanks to its intrinsic nature the present invention permits marking of the tube on the surface thereof without it being required a flat, reinforced area onto which to print different plastic layers.

The result is an economical and easily manufactured test tube that permits to use the existing stock of lateral marking code readers.

DETAILED EXPLANATION OF THE INVENTION

The present invention consists of a test tube of the type used for chemical and biological analysis made of a single piece. It includes walls and a tube bottom that delimit the cylindrical or approximately cone-shaped shape of the test tube. The tube has ordinarily an aperture located at the upper area thereof for introducing substances.

In accordance with the objects of the present invention, the tube is translucent for enabling visual inspection of the contents thereof and the level of fluid contained therein.

As far as the embodiment of the invention is concerned, it can be used any method for forming polymer test tubes: injection, thermal blowing, thermal forming, etc. The result is a single piece, without parts, that is, an integral tube.

It is used as the base material of the tube a polymer of the metallocene polyolefins family. In the preferred embodiment of the invention the polymers selected are LUMICENE MR30MX0, a metallocene thermoplastic, molded polypropylene random copolymer with a melt flow index of 30 g/10 min, of Total Petrochemicals or METOCENE HM648T, a conductive anti-static metallocene catalyst-based polymer with a melt flow rate of 61 g/10 min,of Lyondellbasell.

Furthermore, special activation components in a suitable concentration that are added to the base material of tube become necessary. These additives will enable subsequent marking of a reference code by means of laser technology.

The additive employed is a polypropylene-based Masterbatch for a correct fusion with the working polymer. The main component in the preferred embodiment of the invention is a laser sensitive pigment in which each pigment particle is a mica flake that acts as an infrared reflector with an external light-absorbing compound made of metal oxide (preferably LAZER FLAIR 825 of Merck Chemicals, which became known as IRIOTEC 8825 in the year 2011).

The laboratory tests and technical tests conducted have determined the selection of the materials and the most suitable proportions thereof, as can be seen in the tables below. The values correspond to a particular scale for rating the suitability of the result obtained or the magnitudes indicated in the title of the column.

TABLE I

| Masterbatch Lazerflair % | Lateral marking | Transparency |
|---|---|---|
| 2 | 28 | 5 |
| 1 | 25 | 10 |
| 0.5 | 24 | 15 |
| 0.25 | 10 | 18 |
| 0 | 2 | 20 |

TABLE II

| Material PP | Transparency | Liquid Retention | Mechanical resistence | Injection performance |
|---|---|---|---|---|
| TotalFina PPH9081 | 15 | 19 | 9 | 26 |
| Lumicene MR30MX0 | 28 | 20 | 9 | 15 |
| Metocene HM648T | 25 | 18 | 7 | 28 |
| Purell RP373R | 10 | 16 | 8 | 23 |
| Purell RP374R | 10 | 16 | 8 | 23 |
| Lumicene RMR30MC2 | 25 | 16 | 8 | 26 |

In view of the tests conducted, the best proportion of LAZERFLAR 825, the laser sensitive pigment, in the masterbatch of polypropylene is 0.5%, both LUMICENE MR30MX0, a metallocene random copolymer, and Metocene HM648T, a metallocene catalyst-based polymer, yield good results as well.

It is to be noted that in this selection it has been taken into account the economic cost of manufacturing the tube and the qualities thereof.

Below is a description of particular embodiment case.

Case I

The manufacturing process of this example of embodiment is carried out through the injection molding technique.

First, the base material is prepare by means of a mixture of the LUMICENE MR30MX0, the metallocene random copolymer, or the METOCENE HM648T, the metallocene catalyst-based polymer, obtained in rotating drums, with approximately 0.5%-2% by weight of the Masterbatch that includes the LAZER FLAIR 825, the laser sensitive pigment, product. Both products are then in a solid phase in portions of 1 $mm^3$.

Once the mixture has been obtained in the most homogeneous fashion possible introduction of the material in the injection machine takes place. Said machine moves on then to perform the complete melting of the polymer-additive mixture at a temperature of approximately between 200-240° C. and a pressure of between 100-250 barg.

When both materials have been melted, under these pressure and temperature conditions, it is formed a homogeneous fluid that is impossible to be divided into the two original components.

The injection machine, having a particular cycle time, introduces the flux mixture in a mould having the shape of the piece and made of a metallic material. After a series of injection, cooling and ejection processes, it is formed the piece in an indivisible unit.

Laser Marking

For performing the marking of the test tube it is necessary to utilize a laser light beam. The marker performs on the material forming the tube a mark that cannot be removed unless said tube is partially or fully fractured.

The marker utilized in the preferred embodiment described herein is a compact diode-pumped solid-state laser (preferably the TRUMPF model Trumark 3020). This is a Nd:YAG laser that works with a wavelength of approximately 1064 nm and a focal of approximately 160 mm, it having a focal diameter of approximately 50 μm.

For the marking the test tube is positioned perpendicular to the lens that emits the laser beam focus. Once the tube is positioned, by means of the software that controls the laser it is configured the reference code. Once configured and after the order of emitting the laser beam is issued, said beam of laser light causes the molecules of the additive present in the tube material to respond to the excitation with a brown-black color, which enhances a contrast with the translucent background of the tube and enables optical readout of a reference code.

Since said code has been generated by the change of color of the polymer of the test tube, removal thereof is not possible unless the tube is significantly damaged and is as a result permanently rendered unusable.

It is understood that in the present case details with regard to finishing and form may be variable insofar as they do not modify the basic idea of the invention.

The invention claimed is:

1. A test tube of the type that is used for chemical and biological analysis, the test tube comprising:

an approximately cylindrical or approximately cone-shaped shape; and an aperture at an upper area of the approximately cylindrical or approximately cone-shaped shape for facilitating introduction of substances into the test tube;

wherein the test tube is formed from a single piece of material which is a homogeneous and translucent-hued material; and the single piece of material is made from a homogenous mixture of:

a base polymer of a metallocene polyolefins family, and a polypropylene-based masterbatch having a laser-sensitive additive that changes a color thereof to a contrast color, for instance a brown-black color, as a result of an excitation of a laser marker.

2. The test tube according to claim 1, wherein said laser-sensitive additive utilized in said polypropylene-based masterbatch is a laser sensitive pigment having a mica flake pigment particle with an external light-absorbing compound made of metal oxide.

3. The test tube according to claim 2, wherein said base polymer is a metallocene random copolymer with a melt flow index of 30 g 10 minutes or a metallocene catalyst-based polymer.

4. The test tube according to claim 3, wherein the base material forming said test tube is a homogeneous mixture of the metallocene random copolymer or the metallocene catalyst-based polymer, with approximately 0.5% to 2% by weight of the polypropylene-based masterbatch that includes the laser sensitive pigment.

5. The, test tube according to claim 4, wherein the base material forming said test tube is a homogeneous mixture of a polymer-additive that has been fully melted at a temperature of approximately between 200-240 C and a pressure of approximately between 100-250 barg.

6. The test tube according to claim 1, wherein said laser marker is Nd:YAG, which works with a wavelength of approximately 1064 nm and a focal length of approximately 160 mm, the laser having a focal diameter of approximately 50 m.

7. The test tube according to claim 6, wherein said laser marker is a compact diode-pumped solid-state laser.

* * * * *